US007305944B2

(12) United States Patent
Hendriksma

(10) Patent No.: US 7,305,944 B2
(45) Date of Patent: Dec. 11, 2007

(54) CONTROL STRATEGY FOR HYDRAULICALLY-SWITCHED ENGINE MECHANISMS

(75) Inventor: Nick J. Hendriksma, Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/429,009

(22) Filed: May 5, 2006

(65) Prior Publication Data

US 2007/0256652 A1 Nov. 8, 2007

(51) Int. Cl.
*F01L 9/02* (2006.01)

(52) U.S. Cl. ..... 123/90.12; 123/90.13

(58) Field of Classification Search ..... 123/90.12, 123/90.13, 90.16, 90.2, 90.39, 90.41, 90.44
See application file for complete search history.

(56) References Cited

U.S. PATENT DOCUMENTS 5,121,716 A * 6/1992 Takahashi et al. ..... 123/531
5,235,940 A * 8/1993 Nakatani ..... 123/90.16
5,445,116 A * 8/1995 Hara ..... 123/90.16
6,978,746 B2 * 12/2005 Kibler ..... 123/90.12
2005/0005882 A1 1/2005 Bauer et al.

* cited by examiner

*Primary Examiner*—Ching Chang
(74) *Attorney, Agent, or Firm*—Paul L. Marshall

(57) ABSTRACT

A method for distributing lock pin ejections evenly over all the switchable mechanisms in a plurality of switchable mechanisms: establishing a limiting number of lock pin ejections; designating a primary switchable mechanism for the mode change upon command from an engine control module (ECM); employing the designated primary switchable mechanism until the limit is reached; designating another switchable mechanism a primary; employing the second primary mechanism until the limit is reached again; and designating sequentially each of the remaining switchable mechanisms as primary switchable mechanisms, each until the limit is reached again. The ECM counts the activation commands and switches the primary designation when the limit is reached so that each mechanism has the same exposure to ejections, and the number of ejections per mechanism is evenly distributed. If ejection detection means is available, the ECM may accumulate actual ejections for each mechanism and schedule the primary designation change thereupon.

9 Claims, 4 Drawing Sheets

CONTROL STRATEGY FOR HYDRAULICALLY-SWITCHED ENGINE MECHANISMS

TECHNICAL FIELD

The present invention relates to variable valve activation systems for internal combustion engines; more particularly, to timing of actuation devices having hydraulically motivated lock pins for controlling variable activation; and most particularly, to a control strategy for timing the energizing of an oil valve controlling a plurality of activation devices to distribute what is known as lock pin ejections among the population of devices.

BACKGROUND OF THE INVENTION

It is well known in the automotive arts to provide internal combustion engines with activation/deactivation mechanisms for varying the lift and timing of some of the engine combustion valves. For example, a V-6 engine may be modified such that one bank of three cylinders may be deactivated under conditions of low demand by keeping closed the intake and exhaust valves of the three cylinders via a switching mechanism, thus allowing a vehicle to operate on essentially a three-cylinder engine. The resulting fuel savings can be substantial. For another example, through a valve lift switching mechanism, the valves may be provided with a relatively low lift to conserve fuel under conditions of low demand and a higher lift when higher power is required.

The aforementioned switching mechanisms are commonly electrohydraulic. An oil control valve actuated by an electric solenoid feeds pressurized oil to, or withholds oil from, a plurality of spring-loaded hydraulically-actuated lock pin latching mechanisms disposed at some point in the valve train to control the resultant valve lift originated by the engine camshaft.

A known problem with hydraulic actuation of lock pins arises from an uncertainty of the lock pin position at the start of a valve lift event. For a variety of reasons, the pressure change dynamics in the switching gallery are not constant. The resulting variation can produce an undesirable behavior known in the art as "lock pin ejection", which occurs occasionally because the motion of a lock pin cannot be controlled precisely with respect to the beginning of a lift event for a particular cylinder to assure full engagement/disengagement of the lock pin. This problem is aggravated by elevated engine speed, wherein a shorter time is available for lock pin engagement, and/or by a reduced number of independent control signals. A lock pin ejection occurs when there is insufficient lock pin engagement ("partial engagement") with the receiver, at the time the cam initiates a lift event, to sustain the lift event. In such case, engagement is sufficient to only partially open the valve before the lock pin is ejected from engagement back to its unlocked position, resulting in an unplanned mode shift. Such ejections can lead to undesired durability issues for various components associated with the valve train mechanism.

Certain design variables can be optimized to minimize the percentage of switches in which an ejection takes place. However, it may not be possible to eliminate ejections totally. For example, it is advantageous to save on manufacturing cost by grouping a plurality of valve switching mechanisms, such as for three intake valves on one bank of a V-6 engine, under the control of a single oil control valve rather than providing a separate oil control valve and control mechanism for each valve train. Such valves might be numbered, for example, 1, 3, and 5. In the prior art, a switch command is always issued at a given point in an engine cycle (engine crank angle), for example, just before intake valve 1 is scheduled to begin a lift. Valve 1 is thus the initial valve to be switched. Intake valves 3 and 5 will be on other portions of their lift cycles, including being on a base circle portion of their individual cam lobes before another lift is required; hence, there is a high probability that the latching of the mechanisms for valves 3 and 5 will take place fully and without subsequent premature ejection. Thus, for the three valves, lock pin ejections will occur almost exclusively on the valve 1 valve train.

What is needed in the art is a means for distributing evenly the occurrences of lock pin ejection over all the valve trains controlled by a single oil control valve.

It is a principal object of the present invention to minimize durability issues arising from lock pin ejections on each switchable mechanism in a plurality of valve switchable mechanisms controlled by a single oil control valve by distributing lock pin ejections evenly over all the switchable mechanisms.

SUMMARY OF THE INVENTION

Briefly described, a method for distributing lock pin ejections evenly over all the switchable mechanisms in a plurality of switchable mechanisms is based upon defining a predetermined limiting number of events relating to lock pin ejections to create an action trigger, either directly measured or inferred from experimental data on failure rate per number of switch commands. The method includes the steps of:

a) designating a primary switchable mechanism as a first mechanism for switching upon a first command from an activation control module;

b) employing the first mechanism through a first predetermined limiting number of either switching commands or lock pin ejections;

c) designating another of the plurality of switchable mechanisms a successor primary mechanism replacing the first primary mechanism;

d) employing the successor primary mechanism through a second predetermined limiting number which may be equal to the first predetermined limiting number; and e) designating in sequence each of the remaining switchable mechanisms as f) a successor primary mechanism through respective predetermined limiting numbers (which may be equal to one or more of the other predetermined numbers.

The activation control module keeps count of the switching commands and reassigns the primary designation when the predetermined limiting number is reached. Thus, each switchable mechanism has the same exposure to ejections, and the number of ejections per mechanism is evenly distributed.

Alternatively, if a pin ejection detector is available, then the activation control module may accumulate instead the number of actual ejections experienced by each switchable mechanism, rather than the number of switches, and schedule the change of primary designation to distribute the ejections equally across all the mechanisms. Such ejection detection means may include accelerometers, proximeters, or other means for confirming that engagement has or has not occurred. An example of another means is disclosed in U.S. Patent Application Publication No. US 2005/0005882 A1 wherein the time period and shape of a pressure pulse passing through the oil line after actuation of the oil control valve are monitored to ensure that an intended hydraulically-driven pin engagement or disengagement has in fact occurred.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrates only preferred embodiments of the invention, and such exemplifications are not to be construed as limiting the scope of the invention in any manner.

DESCRIPTION OF THE PREFERRED EMBODIMENTS

For ease of presentation below, with respect to the use of the term "switchable mechanism", "switching" or "switchable" means the changing of position of a lock pin in response to application of pressurized oil, irrespective of whether the associated valve is to be activated or deactivated or its lift reduced. In some applications, locking a lock pin will cause valve activation wherein in other applications it will cause valve deactivation; and yet in other applications it will cause the valve lift to change.

As described above, the potential for lock pin ejections increases dramatically as the number of switchable mechanisms controlled by a single oil control valve is increased. This is demonstrated in the comparison between FIG. 1 and FIG. 2.

Figure 1:
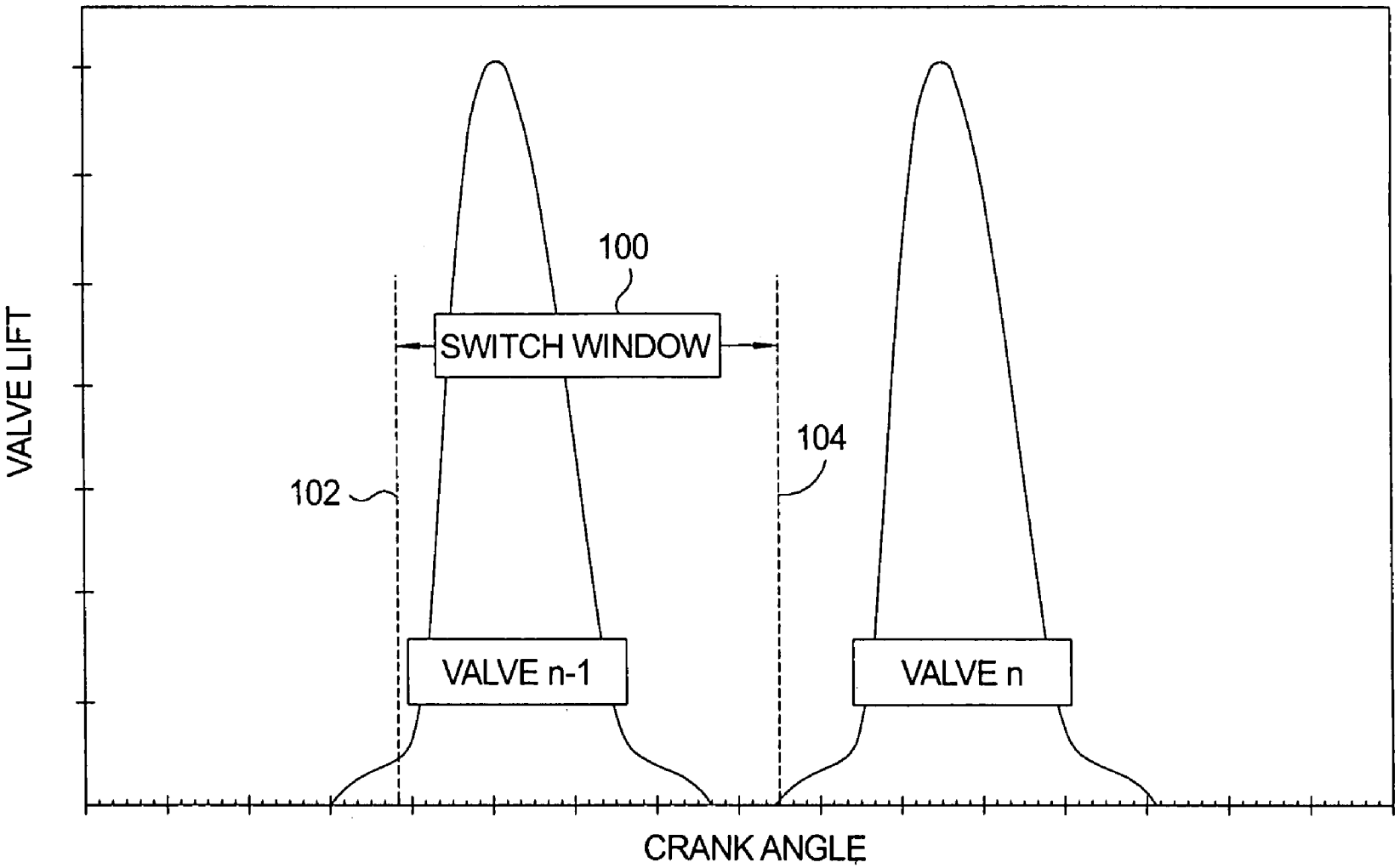
FIG. 1 is a graph of valve lift as a function of crank angle for two engine combustion valves, n−1 and n, controlled by a single oil control valve, showing the duration of the switch window available to prevent lock pin ejection of the switchable mechanism for valve n.

FIG. 1 shows valve lift generically as a function of crank angle for two valves, n−1 and n, when controlled by a single oil control valve, showing the duration of the switch window 100 available to prevent lock pin ejection of the switchable mechanism for valve n. In this case, it is desired that the mode change begin with valve n. Therefore, switch window 100 cannot open (actuation of the oil control valve) at least until the previous engine valve, n−1, has started 102 its lift and engagement of the locking pin to change the mode of valve n−1 becomes impossible; otherwise, valve n−1 may be switched instead of valve n, or worse, valve n−1 may undergo a partial engagement and subsequent ejection. Likewise, switch window 100 cannot extend past the beginning 104 of the lift event for valve n, when motion of the locking pin to change the mode valve n becomes mechanically impossible. In this case, the switch window for valve n is relatively broad, occupying almost the entire lift event for valve n−1, making timing of the oil control valve relatively undemanding for lock pin engagement for valve n.

Figure 2:
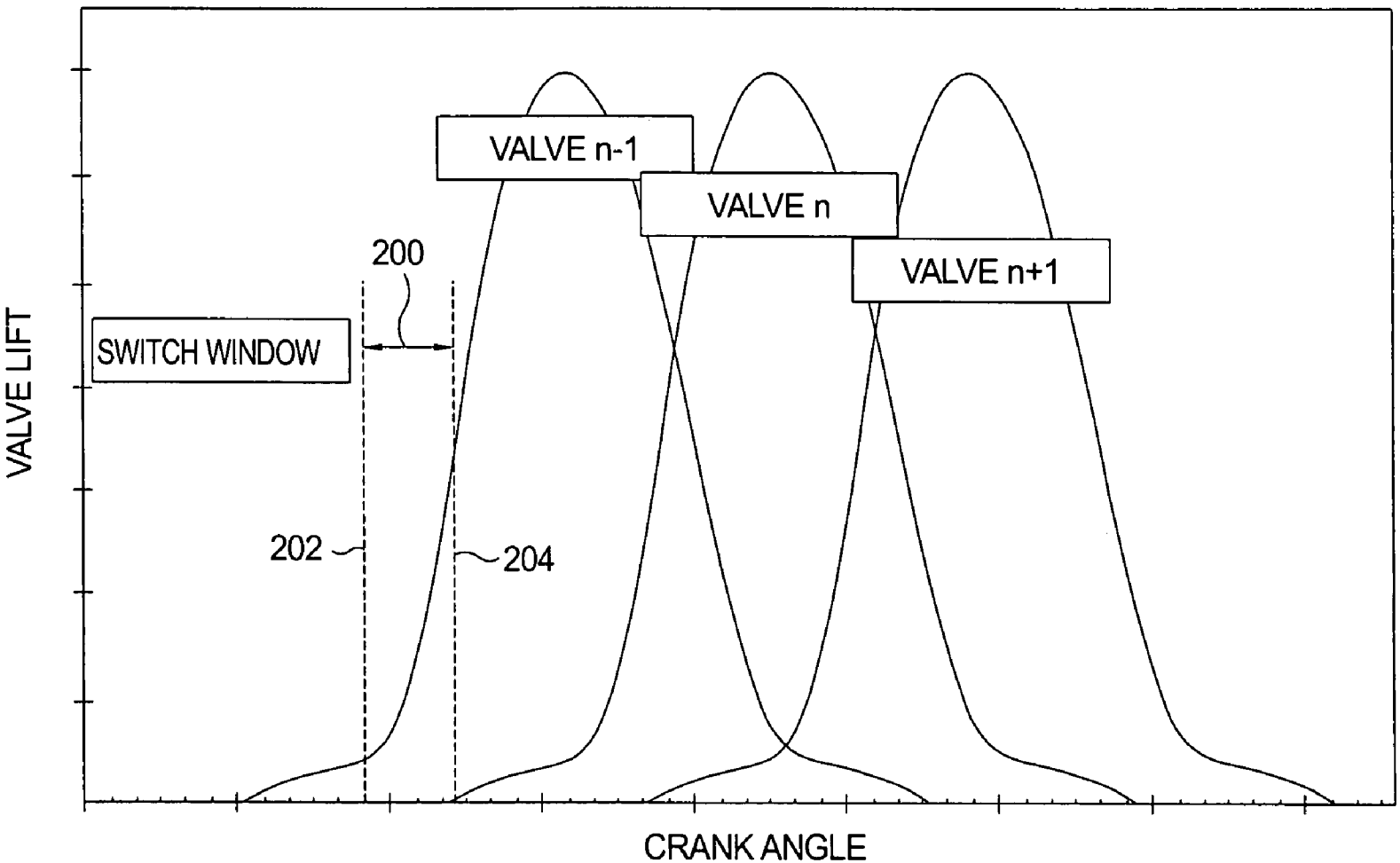
FIG. 2 is a graph similar to the graph shown in FIG. 1 but for three valves n−1, n, and n+1 having overlapping valve lift profiles, showing how the duration of the switch window available to prevent lock pin ejection of the switchable mechanism for valve n is drastically decreased, leading to potential lock pin ejections of valve n.

Referring to FIG. 2, a more realistic example is shown for three valves n−1, n, and n+1 having overlapping valve lift profiles as might occur for the three cylinders in one bank of a V-6 engine. Again, the switch window 200 for valve n cannot begin at least until the previous engine valve, n−1, has started 202 its lift. However, the lift profiles for the three valves are so largely overlapping that the switch window 200 for valve n closes 204 after only a few crank angle degrees. In this case, the operational vagaries of actuation timing within the engine are such that, in a real, present-day, operating engine, lock pin ejections can occur from time to time for the switchable mechanism of valve n. Obviously, if only a few crank degrees within the switch window are taken up by operational uncertainty, lock pin ejections may readily occur.

Recognizing this as a fact however undesirable, the present invention seeks to minimize the deleterious effects of such ejections by distributing them equally over all the valves, rather than accumulating them solely on a single switchable mechanism.

Figure 3:
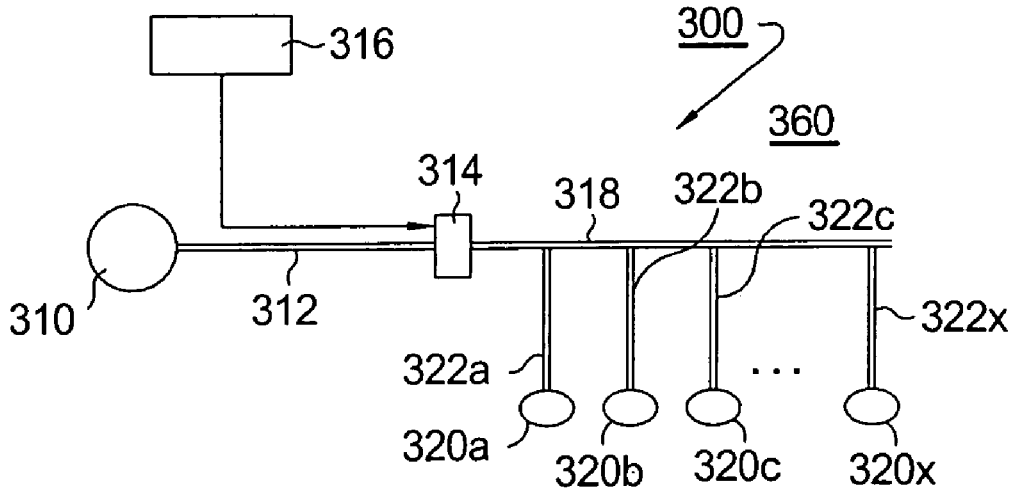
FIG. 3 is a schematic drawing of a first embodiment of a switching control system in accordance with the invention.

Referring to FIG. 3, a first system 300 in accordance with the invention comprises an oil pump 310 for supplying pressurized oil through a first oil supply line 312 to a switchable oil control valve 314 controlled by an engine control module (ECM) 316. A second oil supply line 318 defines an engine oil gallery in an engine 360 for supplying pressurized oil to a plurality of switchable mechanisms 320*a*,320*b*,320*c*, extending to switchable mechanism 320*x*, via individual supply oil supply lines 322*a*,322*b*,322*c*,322*x*. It will be seen that the oil supply lines (318+322) between oil control valve 314 and the individual switchable mechanisms 320*a*,320*b*,320*c*,320*x* are not of equal lengths, and thus the individual switchable mechanisms will respond at slightly different periods of time after actuation of oil control valve 314. Because each switchable mechanism has its own switching window, similar to window 200 in FIG. 2, it becomes important to know what the activation delay is for each mechanism in order to know how each switching window is affected, thus enabling optimal actuation timing of the oil control valve to provide the highest probability of a successful switching event for each switchable mechanism when designated the primary mechanism, in accordance with the invention. The activation delay for each mechanism may be readily characterized for any specific engine design on a test stand and programmed into ECM 316.

From this characterization, an average ejection rate may be inferred for each switchable mechanism, for example one ejection in one thousand switches. The various switchable mechanisms may or may not all have the same ejection rate, but differences are of no consequence to the ECM. In a method in accordance with the invention, during engine operation the ECM first establishes as the primary switchable mechanism one of the mechanisms of the plurality controlled by a single oil control valve, and uses the empirical data table programmed into the ECM to determine when in the crank cycle the oil control valve 314 should be actuated. Preferably, the designated primary switchable mechanism is the mechanism with the lowest number of ejection failures among the plurality of mechanisms. Knowing the inferred ejection rate for that mechanism, the ECM counts the primary activations during running of the engine until a counting event occurs. The counting event may be, for example, that sufficient switches have occurred that a predetermined number of ejections is assumed to have occurred, which number may be one or greater, or that the total number of inferred ejections for that mechanism is no longer the lowest number among the plurality of mechanisms. At that point, designated as the "action trigger", the ECM changes the primary designation to another switchable mechanism, by changing the point in the crank cycle at which the oil control valve is actuated, to coincide with the switching window for the newly-designated primary, and the logic sequence repeats until the next action trigger occurs, and so forth.

Figure 4:
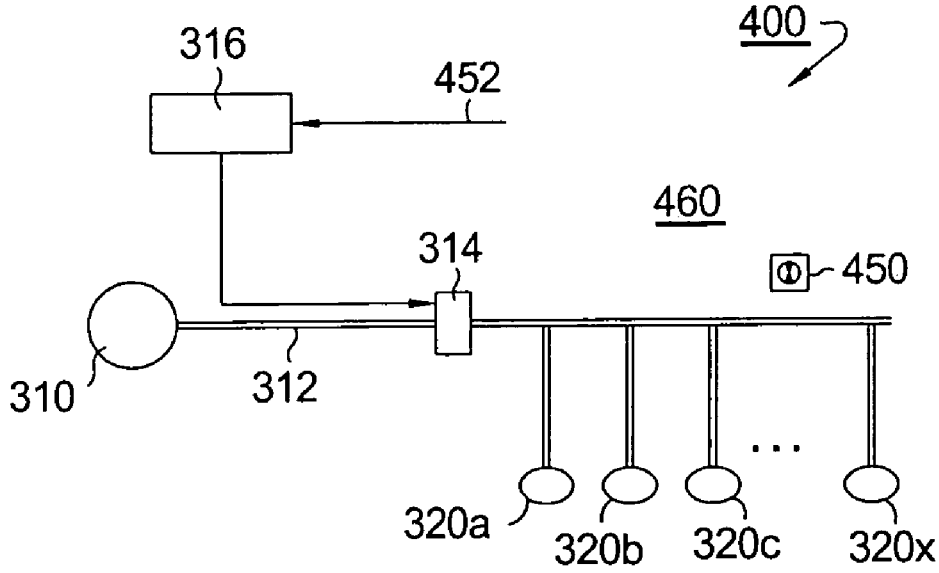
FIG. 4 is a schematic drawing of a second embodiment of a switching control system in accordance with the invention.

Referring to FIG. 4, a second system embodiment 400 of the invention is substantially identical to first system 300 in all respects except that an ejection detector 450 is included in engine 460 and provides a signal 452 to ECM 316. Detector 450 is capable of identifying ejections instantaneously as they occur and relaying that information to the ECM. In this embodiment, the task of the ECM is slightly simpler in that it counts the actual ejections and makes decisions based upon ejection counts, rather than counting the number of switches and making decisions on switch counts. In either mode, the ECM is conducting a count, designating it as the action trigger, and is changing the designated primary switchable mechanism when a predetermined count limit (or action trigger) is reached.

Ejection detector 450 may be, for example, an accelerometer mounted on the head of engine 460 which is able to detect the shock wave generated by a lock pin ejection and transmitted through the engine. Knowing what switchable mechanism is currently designated as primary, the ECM is able to associate each detected ejection with the correct switchable mechanism. Other types of ejection detectors employing sonic or optical means, as well as other diagnostic means, as will readily occur to those of skill in the art are fully comprehended by the invention.

Figure 5:
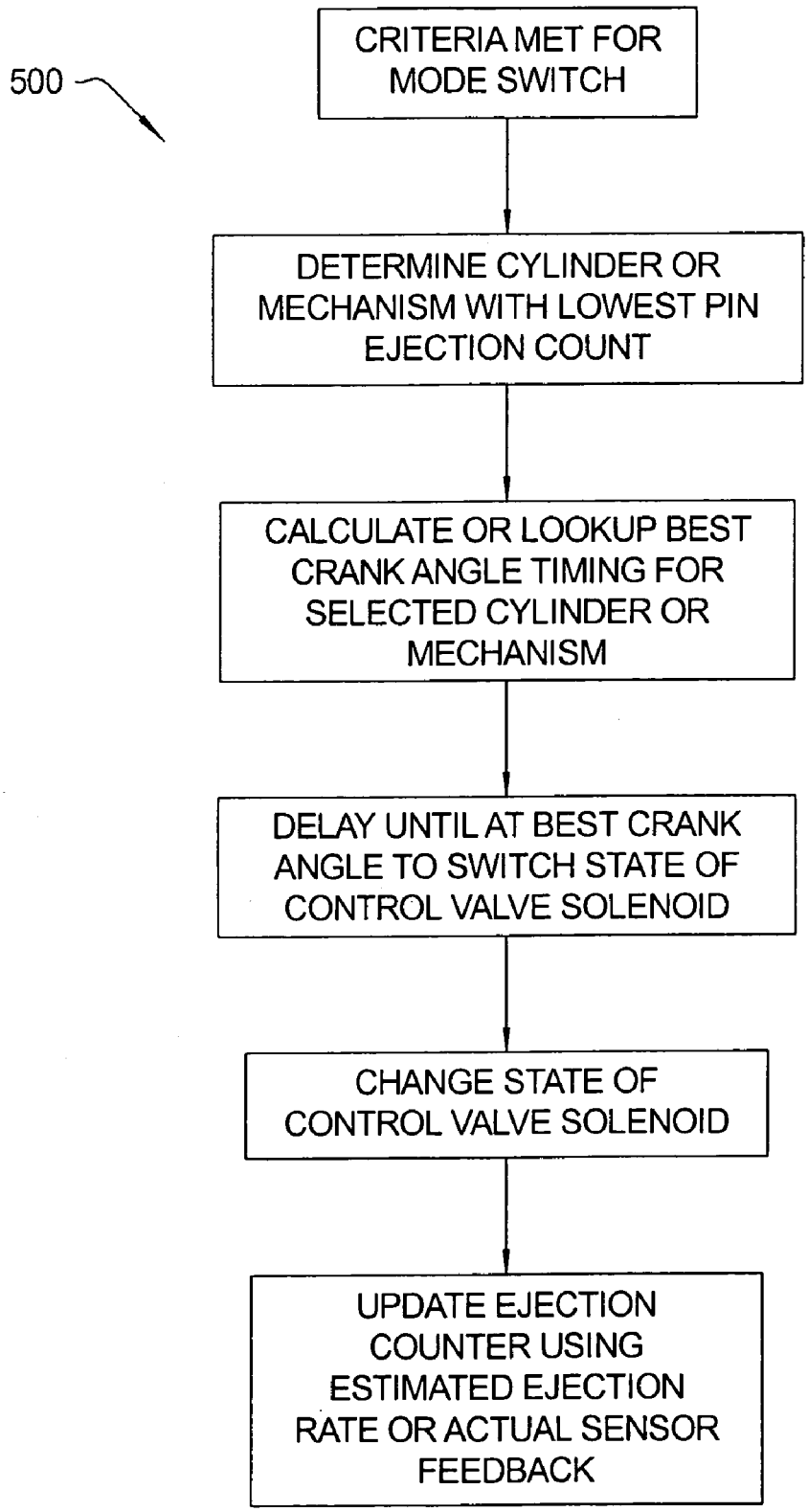
FIG. 5 is a flow algorithm for controlling a switching control system in accordance with the invention.

Referring to FIG. 5, and typical algorithm 500 for performing the invention includes the following indicated steps.

First, criteria must be set such that a mode switch is desired requiring motion of a lock pin. These criteria are predetermined and programmed into ECM 316, and may include factors such as engine speed and load.

When satisfaction of the criteria is confirmed, the ECM finds the activation mechanism having the lowest number of accumulated ejections, either by direct measurement or using an estimated ejection rate, and designates that mechanism as the primary. The ECM then refers to pre-programmed data about the switching delay for that primary mechanism and determines at what crank angle the oil control valve solenoid must be actuated. When that crank angle arrives, the ECM actuates (or deactuates) the oil control valve solenoid. The ECM then notes the new primary designation and updates the ejection counter for the various switchable mechanisms.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. In an internal combustion engine having oil flow to a plurality of valve train switchable mechanisms controlled by one oil control valve, wherein a lock pin ejection may occur upon a switching command from a controller to undergo a mode change of said plurality of valve train switchable mechanisms controlled by said one oil control valve, a method for distributing at least one lock pin ejection across the population of said plurality of valve train switchable mechanisms, comprising the steps of:

a) designating one of said plurality of valve train switchable mechanisms as a first primary mechanism for undergoing said mode change upon said switching command from said controller;

b) defining a first predetermined limiting number of events relating to said at least one lock pin ejection for said first primary mechanism to create a first primary action mechanism action trigger;

c) employing said first primary mechanism through said first predetermined limiting number of events;

d) designating another of said plurality of valve train switchable mechanisms as a successor primary mechanism replacing said first primary mechanism;

e) defining a second predetermined limiting number of events relating to said at least one lock pin ejection for said successor primary mechanism to create a successor primary action mechanism action trigger;

f) employing said successor primary mechanism through said second predetermined limiting number of events; and g) designating in sequence each of said remaining said plurality of valve train switchable mechanisms as a successor primary mechanism and defining a predetermined limiting number of events for each successor primary mechanism.

2. A method in accordance with claim 1 wherein said first predetermined limiting number of events is the same as the second predetermined limiting number of events.

3. A method in accordance with claim 1 wherein said internal combustion engine further comprises an ejection detector.

4. A method in accordance with claim 3 wherein said ejection detector configured for counting a number of ejection failures for each of said plurality of mode switching mechanisms, and wherein said first primary mechanism is designated as one of said plurality of mode switching mechanisms with the lowest number of ejection failures among said plurality of mode switching mechanisms.

5. A method in accordance with claim 1 wherein the method for determining said predetermined limiting number of events is selected from the group consisting of direct sensing of said at least one lock pin ejection and inference of said at least one lock pin ejection.

6. A method in accordance with claim 5 wherein said inference of said at least one lock pin ejection is derived from experiential data on lock pin ejection rate per number of said switching commands.

7. An internal combustion engine comprising:

a plurality of mode switching mechanisms, each of said plurality of mode switching mechanisms including a lock pin for affecting a mode change;

one oil control valve for controlling each of said plurality of mode switching mechanisms; and a controller configured to send a switching command to each of said plurality of mode switching mechanisms, wherein at least one lock pin ejection may occur in a primary designation, said primary designation being one of said plurality of mode switching mechanisms to undergo said mode change upon said switching command received from said controller, and wherein said controller is configured for controllably distributing said at least one lock pin ejection selectively across the population of said plurality of mode switching mechanisms by controllably varying said primary designation among said plurality of mode switching mechanisms.

8. An internal combustion engine in accordance with claim 7 further including an ejection detector for each of said plurality of mode switching mechanisms, said ejection detector configured for counting a number of ejection failures for each of said plurality of mode switching mechanisms.

9. An internal combustion engine in accordance with claim 8 wherein said controller is configured to controllably vary said primary designation by selecting one of said plurality of mode switching mechanisms with the lowest number of ejection failures among said plurality of mode switching mechanisms.

* * * * *